US009759233B2

(12) United States Patent
Sakaguchi et al.

(10) Patent No.: US 9,759,233 B2
(45) Date of Patent: Sep. 12, 2017

(54) STATOR MEMBER AND VACUUM PUMP

(71) Applicants: Yoshiyuki Sakaguchi, Yachiyo (JP); Satoshi Okudera, Yachiyo (JP)

(72) Inventors: Yoshiyuki Sakaguchi, Yachiyo (JP); Satoshi Okudera, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 528 days.

(21) Appl. No.: 14/349,022

(22) PCT Filed: Oct. 3, 2012

(86) PCT No.: PCT/JP2012/075616
§ 371 (c)(1),
(2) Date: Apr. 1, 2014

(87) PCT Pub. No.: WO2013/065440
PCT Pub. Date: May 10, 2013

(65) Prior Publication Data

US 2014/0241872 A1 Aug. 28, 2014

(30) Foreign Application Priority Data

Oct. 31, 2011 (JP) ..... 2011-239457

(51) Int. Cl.
*F04D 19/04* (2006.01)
*F04D 29/58* (2006.01)
(Continued)

(52) U.S. Cl.
CPC ..... *F04D 29/5853* (2013.01); *F04D 19/04* (2013.01); *F04D 19/042* (2013.01);
(Continued)

(58) Field of Classification Search
CPC ... F01D 5/18; F01D 5/187; F01D 5/08; F01D 5/186
See application file for complete search history.

(56) References Cited

U.S. PATENT DOCUMENTS 5,350,275 A * 9/1994 Ishimaru ..... F04D 19/042 415/200
5,695,316 A * 12/1997 Schutz ..... F04D 17/168 415/143
(Continued)

FOREIGN PATENT DOCUMENTS

CN 1971890 A 5/2007
JP H074383 A 1/1995
(Continued)

OTHER PUBLICATIONS

JP 10122179 A English Translation.*
(Continued)

*Primary Examiner* — Mark Laurenzi
*Assistant Examiner* — Shafiq Mian
(74) *Attorney, Agent, or Firm* — Westman, Champlin & Koehler, P.A.; Theodore M. Magee

(57) ABSTRACT

To provide a stator member that facilitates thermal radiation from a surface thereof and thermal conduction to an adjacent member, and a vacuum pump that contains the stator member. For the purpose of enhancing heat dissipation of a rotor portion, surface treatment removal processing is performed on a predetermined section of a thread groove spacer in order to efficiently release heat of the thread groove spacer toward a base and a stator blade spacer. More specifically, the surface treatment removal processing removes the surface treatment of the base and a section where the stator blade spacer comes into contact with the thread groove spacer. This surface treatment removal processing is executed simultaneously with finishing processing.

7 Claims, 4 Drawing Sheets

(51) Int. Cl.
*F04D 29/52* (2006.01)
*F04D 29/54* (2006.01)
*F04D 29/02* (2006.01)

(52) U.S. Cl.
CPC ..... *F04D 29/023* (2013.01); *F04D 29/522* (2013.01); *F04D 29/541* (2013.01); *F05D 2300/603* (2013.01)

(56) References Cited

U.S. PATENT DOCUMENTS 6,343,910 B1 * 2/2002 Kawasaki ..... F04D 19/046 415/177
6,585,480 B2 * 7/2003 Kawasaki ..... F04D 19/046 415/90
6,793,466 B2 * 9/2004 Miyamoto ..... F04D 19/04 415/177
6,890,145 B2 * 5/2005 Takamine ..... F04D 19/04 415/217.1
6,926,493 B1 * 8/2005 Miyamoto ..... F04D 19/042 415/143
2002/0113509 A1 * 8/2002 Maejima ..... F04D 19/048 310/90.5
2003/0161733 A1 * 8/2003 Kabasawa ..... F04D 29/584 417/32
2003/0185272 A1 * 10/2003 Miwata ..... F04D 19/04 374/120
2004/0081569 A1 * 4/2004 Sakaguchi ..... F04D 19/04 417/423.4
2005/0025640 A1 * 2/2005 Sekiguchi ..... F04D 17/168 417/423.4
2005/0249618 A1 * 11/2005 Nonaka ..... F04D 19/04 417/423.4
2009/0081056 A1 * 3/2009 Maejima ..... F04D 19/042 417/363
2012/0034066 A1 * 2/2012 Kogame ..... F04D 19/042 415/90
2013/0243583 A1 * 9/2013 Kawanishi ..... F04D 19/046 415/191

FOREIGN PATENT DOCUMENTS

JP H0730395 6/1995
JP H08145307 A 6/1996
JP H0932793 A 2/1997
JP 10122179 A * 5/1998
JP H10122179 A 5/1998
JP 2000064986 A 3/2000
JP 2000205181 A 7/2000
JP 2005320905 A 11/2005
JP 2010112202 A 5/2010

OTHER PUBLICATIONS

First Office Action dated Sep. 6, 2015 for corresponding Chinese Application No. 201280051049.9.
Communication dated May 7, 2015 and European Search Report dated Apr. 22, 2015 for corresponding EP Application No. 12846285.0-1608.
PCT International Search Report dated Dec. 18, 2012 for corresponding PCT Application No. PCT/JP2012/075616.
Notice of Reasons for Rejection and Search Report dated Jul. 15, 2016 for corresponding Taiwanese Application No. 101140144.
Notice of Reasons for Rejection dated Sep. 2, 2016 for corresponding Japanese Application No. JP2013-541683.

* cited by examiner

STATOR MEMBER AND VACUUM PUMP

CROSS-REFERENCE TO RELATED APPLICATION

This application is a Section 371 National Stage Application of International Application No. PCT/JP2012/075616, filed Oct. 3, 2012, which is incorporated by reference in its entirety and published as WO 2013/065440 A1 on May 10, 2013 and which claims priority of Japanese Application No. 2011-239457, filed Oct. 31, 2011.

BACKGROUND

Field of the Invention

The present invention relates to a stator member and a vacuum pump. Particularly, the present invention relates to a stator member that facilitates thermal radiation from a surface thereof and thermal conduction to an adjacent member, and a vacuum pump that contains the stator member.

Description of the Related Art

Among various vacuum pumps, there are turbomolecular pumps and thread groove type pumps that are often used to form a high vacuum environment.

A chamber for semiconductor manufacturing equipment, a test chamber of an electron microscope, a surface analysis device, a microfabrication device, and the like are the examples of vacuum systems that keep the insides thereof vacuum through an exhaust treatment using those vacuum pumps such as turbomolecular pumps or thread groove type pumps.

Such a vacuum pump for realizing a high vacuum environment has a casing that configures a housing having an inlet port and an outlet port. A structure that exerts an exhaust function of the vacuum pump is accommodated in this casing. This structure exerting an exhaust function is basically configured by a rotary portion (rotor portion) that is supported rotatably and a stator portion that is fixed to the casing.

In case of a turbomolecular pump, a rotary portion thereof has a rotating shaft and a rotating body fixed to the rotating shaft, wherein the rotating body has a plurality of stages of rotor blades (moving blades) disposed radially. The stator portion, on the other hand, has a plurality of stages of stator blades (stationary blades) disposed alternately with respect to the rotor blades.

The turbomolecular pump is also provided with a motor for rotating the rotating shaft at high speed. When the rotating shaft is rotated at high speed through the operation of the motor, gas is introduced through the inlet port by the interaction between the rotor blades and the stator blades and then pumped out from the outlet port.

In this type of vacuum pump, the cylindrical rotary portion that is rotated at high speed is normally made of metal such as aluminum or aluminum alloy. However, for the purpose of achieving better performance (especially in order to rotate the rotary portion at higher speed), a fiber reinforced composite material (fiber reinforced plastics, referred to as "FRP material," hereinafter) is used recently to manufacture a rotary portion due to its characteristics of lighter weight and higher strength as compared to metal.

Examples of fibers used in the FRP material include aramid fiber (AFRP), boron fiber (BFRP), fiberglass (GFRP), carbon fiber (CFRP), and polyethylene fiber (DIRP).

Incidentally, in this type of vacuum pump, the rotary portion including the rotary blades that is rotated at high speed often reaches a temperature above 100° C. and equal to or greater than 150° C. due to the exhaust of process gas.

When the rotor portion is continuously rotated at high speed with the rotor portion being heated in this manner, creep phenomena occur, which is a problem in connection with the durability of the rotor portion.

Therefore, the rotor portion needs to be configured to dissipate heat more efficiently. In other words, thermal radiation from the rotor portion and thermal absorption on the surface of the stator portion facing the rotor portion need to be facilitated.

Japanese Patent Application Publication No. 2005-320905 proposes a technology for improving corrosion resistance and heat dissipation properties of a vacuum pump by providing a surface treatment layer configured by a nickel alloy layer and a nickel oxide film to a surface of a component incorporated in the vacuum pump.

Japanese Patent No. 3098139 proposes a technology related to a compound molecular pump in which a rotor of a turbomolecular pump portion is made of metal and a cylindrical rotor of a thread groove pump portion and a supporting plate joining the rotors of these pump portions together are made of FRP, thereby not only improving the exhaust speed and compression ratio of the pump but also reducing the size and weight of the pump.

The discussion above is merely provided for general background information and is not intended to be used as an aid in determining the scope of the claimed subject matter. The claimed subject matter is not limited to implementations that solve any or all disadvantages noted in the background.

SUMMARY

Although the invention of Japanese Patent Application Publication No. 2005-320905 is configured to improve the heat dissipation properties by means of the thermal radiation, the problem of such configuration is that the thermal conduction between the member provided with the surface treatment layer and the member adjacent becomes deteriorated in the rotary portion and the stator portion.

On the other hand, the invention of Japanese Patent No. 3098139 is configured to make the rotating body lighter and stronger, but the thermal conductivity of FRP, the material configuring the cylindrical rotor of the thread groove pump portion, is lower than that of aluminum alloy configuring the rotor of the turbomolecular pump portion, and temperature distribution is likely to be generated. Due to significant friction between gas and the outlet port, the section around a lower end portion of the cylindrical rotor of the thread groove pump portion in the vicinity of the outlet port is heated, and this built up heat makes the temperature of the cylindrical rotor of the thread groove pump portion higher than that of the rotor of the turbomolecular pump portion, causing the problem in connection with the durability of the rotor portion, as described above.

There is a method for lowering the temperature of the cylindrical rotor by introducing a gaseous matter thereto and radiating the gaseous matter into the space. However, depending on the type of gas flowing through the vacuum pump, the temperature of the gaseous matter cannot be reduced.

An object of the present invention, therefore, is to provide a stator member that facilitates thermal radiation from a surface thereof and thermal conduction to an adjacent member, and a vacuum pump that contains the stator member therein.

One embodiment provides a stator member, which is disposed inside a casing having an inlet port and an outlet port, and which faces a rotating body provided in a gas transfer mechanism that is disposed on a rotating shaft and transfers gas from the inlet port to the outlet port, and moreover which is subjected to a surface treatment in at least a part thereof, wherein the stator member is not subjected to the surface treatment on a contact surface that is in contact with at least one of other members. In some embodiments, a vacuum pump is provided that has the casing, the rotating shaft, the rotating body, and the stator member. In some embodiments, the rotating body is joined to a cylindrical body made of a fiber reinforced composite material.

In a further embodiment the gas transfer mechanism has a thread groove type pump portion and the stator member is a thread groove spacer. In some embodiments, the thread groove spacer is not subjected to the surface treatment at least on a part of a surface of the thread groove spacer that faces the rotating body.

In a further embodiment the gas transfer mechanism has a turbomolecular pump portion and the stator member is a stator blade spacer.

In a further embodiment, the gas transfer mechanism has a turbomolecular pump portion and the stator member is a stator blade.

Embodiments of the present invention provide a stator member that facilitates thermal radiation from a surface thereof and thermal conduction to an adjacent member, and a vacuum pump that contains the stator member therein.

The Summary is provided to introduce a selection of concepts in a simplified form that are further described in the Detail Description. This Summary is not intended to identify key features or essential features of the claimed subject matter, nor is it intended to be used as an aid in determining the scope of the claimed subject matter.

DETAILED DESCRIPTION

(i) Outline of Embodiments (a) A vacuum pump such as a thread groove type pump with a thread groove type pump portion or a compound turbomolecular pump has a thread groove spacer with a large heat capacity which is configured to receive heat radiated from a rotor portion and release the heat to the outside by thermal radiation or thermal conduction, to reduce the temperature of the rotor portion.

For the purpose of enhancing heat dissipation of a rotor portion, a vacuum pump according to an embodiment of the present invention executes surface treatment removal processing on a predetermined section of a thread groove spacer in order to efficiently release heat from the thread groove spacer to the base side and to the stator blade spacer side. More specifically, the vacuum pump of the present invention removes the surface treatment of the base and a section where a stator blade spacer comes into contact with the thread groove spacer.

The vacuum pump according to the embodiment of the present invention is configured to execute the surface treatment removal processing and finishing processing at the same time.

(ii) Details of the Embodiments

Preferred embodiments of the present invention are described hereinafter in detail with reference to FIGS. 1 to 4.

As an example of a vacuum pump, the first, second and third embodiments illustrate a so-called compound turbomolecular pump that has a turbomolecular pump portion, a thread groove type pump portion, and a cylindrical rotating body made of FRP.

Note that the present invention may be applied to a vacuum pump that only has a turbomolecular pump portion or a thread groove type pump portion, as well as to a vacuum pump that has a thread groove provided on the rotating body side thereof.

(ii-1) First Embodiment (Thread Groove Spacer that Surface Treatment Removal Processing is Performed)

Figure 1:
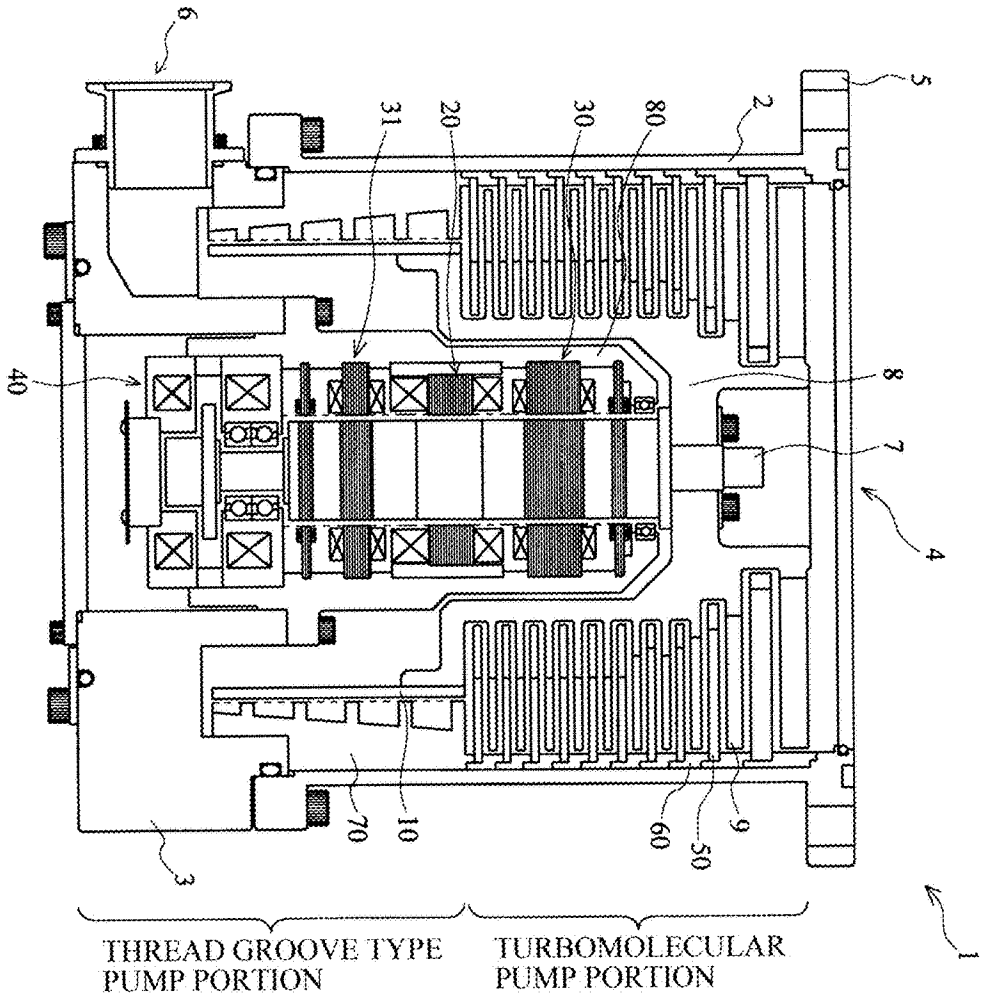
FIG. 1 is a diagram showing an example of a schematic configuration of a turbomolecular pump according to first, second and third embodiments of the present invention.

FIG. 1 is a diagram showing an example of a schematic configuration of a turbomolecular pump 1 according to the first embodiment of the present invention.

Note that FIG. 1 shows an axial cross-sectional view of the turbomolecular pump 1.

A casing 2 of the turbomolecular pump 1 has a substantially cylindrical shape and configures a housing of the turbomolecular pump 1 together with a base 3 provided under the casing 2 (near an outlet port 6). A gas transfer mechanism, a structure that brings out an exhaust function of the turbomolecular pump 1, is stored in this casing.

This gas transfer mechanism is basically configured by a rotary portion (rotor portion) that is supported rotatably and a stator portion that is fixed to the casing.

Although not shown, a control device for controlling the operations of the turbomolecular pump 1 is connected to an external portion of the casing of the turbomolecular pump 1 by a dedicated line.

An inlet port 4 for introducing gas into the turbomolecular pump 1 is formed at an end portion of the casing 2. A flange portion 5 is formed on an end surface of the casing 2 on the inlet port 4 side in such a manner as to protrude toward an outer circumference of the casing 2.

In addition, the outlet port 6 for pumping out the gas from the turbomolecular pump 1 is formed at the base 3.

The rotary portion is configured by a shaft 7, which is a rotating shaft, a rotor 8 disposed on this shaft 7, a plurality of rotary blades 9 provided on the rotor 8, a cylindrical rotating body 10 provided on the outlet port 6 side (thread groove type pump portion), and the like. Note that the rotor portion is configured by the shaft 7 and the rotor 8.

Each of the rotary blades 9 is tilted by a predetermined angle with respect to a plane perpendicular to an axis line of the shaft 7 and extends radially from the shaft 7.

The cylindrical rotating body 10 is configured by a cylindrical member that is concentric with the axis of rotation of the rotor 8.

A motor portion 20 for rotating the shaft 7 at high speed is provided around the center of the shaft 7 in the axial direction thereof and contained in a stator column 80.

Furthermore, radial magnetic bearing devices 30, 31 for supporting the shaft 7 in a radial direction in a non-contact manner are provided on the inlet port 4 side and the outlet port 6 side of the shaft 7, respectively, with respect to the motor portion 20, and an axial magnetic bearing device 40 for supporting the shaft 7 in an axial direction in a non-contact manner is provided at a lower end of the shaft 7.

The stator portion is formed on an inner circumference of the casing. This stator portion is configured by a plurality of stator blades 50 provided on the inlet port 4 side (turbomolecular pump portion), a thread groove spacer 70 provided on an inner circumferential surface of the casing 2, and the like.

Each of the stator blades 50 is tilted by a predetermined angle with respect to a plane perpendicular to the axis line of the shaft 7 and extends from an inner circumferential surface of the casing toward the shaft 7.

The stator blades 50 of each step is fixed at intervals by cylindrical stator blade spacers 60 respectively.

In the turbomolecular pump portion, the plurality of stages of the stator blades 50 and the plurality of stages of the rotary blades 9 are arranged alternately in the axial direction.

A spiral groove is formed at surfaces of the thread groove spacer 70 that face the cylindrical rotating body 10.

The thread groove spacer 70 faces an outer circumferential surface of the cylindrical rotating body 10 with a predetermined clearance therebetween, and is configured to send gas, compressed in the turbomolecular pump 1, toward the outlet port 6 side while guiding the gas along the thread groove (spiral groove) as the cylindrical rotating body 10 rotates at high speed. In other words, the thread groove configures a flow path for transporting the gas. The gas transfer mechanism for transferring gas is configured by this thread groove that is formed by the thread groove spacer 70 and the cylindrical rotating body 10 facing each other with a predetermined clearance therebetween.

The smaller this clearance is, the better, in order to reduce the force of gas flowing back toward the inlet port 4.

The spiral groove formed in the thread groove spacer 70 extends toward the outlet port 6, in a case where the gas is transported through the spiral groove in a direction of rotation of the rotor 8.

The spiral groove is also configured to become shallower toward the outlet port 6, so the gas that is transported through the spiral groove is compressed more toward the outlet port 6. In such a configuration, the gas that is introduced from the inlet port 4 is compressed in the turbomolecular pump portion, then further compressed in the thread groove type pump portion, and pumped out from the outlet port 6.

The turbomolecular pump 1 with this configuration can execute an evacuation treatment in a vacuum chamber (not shown) disposed in the turbomolecular pump 1.

In the turbomolecular pump 1 according to the first embodiment of the present invention, the thread groove spacer 70 is subjected to a surface treatment producing high emissivity (i.e., high thermal absorptivity), such as a nickel oxide coating treatment or an alumite treatment (anodic oxidation coating with aluminum and aluminum alloy).

Figure 2:
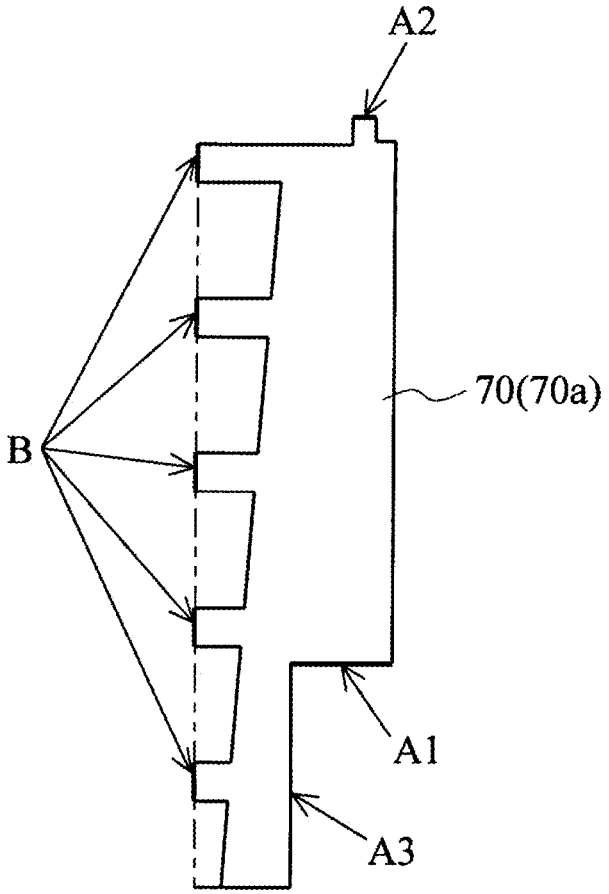
FIG. 2 is an enlarged view of a thread groove spacer according to the first embodiment of the present invention.

FIG. 2 is an enlarged view of the thread groove type pump portion of the thread groove spacer 70 according to the first embodiment of the present invention.

Executing this treatment on the thread groove spacer 70 results in high thermal absorption, but a lower thermal conductivity than that obtained prior to the execution of the surface treatment, and to avoid smooth conduction of the heat of the thread groove spacer 70 to the base 3 and the stator blade spacers 60.

For the purpose of efficiently absorbing the heat of the thread groove spacer 70 (i.e., efficiently releasing the heat of the thread groove spacer 70), in the turbomolecular pump 1 according to the first embodiment of the present invention, a contact surface A1 of the thread groove spacer 70 that is in contact with the base 3 and a contact surface A2 that is in contact with the stator blade 50 are subjected to surface treatment removal processing for removing the surface treatment thereof, to expose the original base metal.

Owing to the configuration described above of the turbomolecular pump 1 according to the first embodiment of the present invention, the heat of the thread groove spacer 70 can efficiently be released, resulting in efficient heat dissipation of the rotor (cylindrical rotating body 10).

The following step (A) or (B) is carried out in the process for manufacturing the thread groove spacer 70 of the turbomolecular pump 1 according to the first embodiment of the present invention.

Rough machining→Finishing processing→Masking process→Surface treatment

Rough machining→Finishing processing→Surface treatment→Surface treatment removal processing It should be noted that, in step (A), a form that roughly resembles the thread groove spacer 70 is created in the rough machining process, and then the finishing processing is performed on a portion of the created form that requires precision, thereby producing precision. The masking process is performed beforehand on a portion of the created form that does not require a surface treatment, and then the surface treatment is executed.

In step (B), on the other hand, a form that roughly resembles the thread groove spacer 70 is created in the rough machining process or the like, and then the finishing processing is performed on a portion of the created form that requires precision, thereby producing precision. Instead of executing the masking process, the surface treatment is performed and thereafter the surface treatment removal processing is carried out on the contact surface A1, the contact surface A2, and a contact surface A3.

Modification of the First Embodiment

The following step (C) is carried out in the process for manufacturing the thread groove spacer 70 according to a modification of the first embodiment of the present invention.

(C) Rough machining→Surface treatment→Finishing processing (surface treatment removal processing is performed at the same time)

In other words, in step (C), the surface treatment is executed subsequently to the rough machining process, and thereafter the finishing processing (process for producing dimensional precision) is carried out. Specifically, in the modification of the first embodiment of the present invention, the finishing processing and surface treatment removal processing are executed simultaneously after the completion of the surface treatment on the entire surface of the thread groove spacer 70.

It should be noted in step (C) that surfaces B of the thread groove spacer 70 that face the cylindrical rotating body 10 (FIG. 2) might also be subjected to the surface treatment removal processing. The reason that the surfaces B are subjected to the surface treatment removal processing is because these surfaces are where dimensional precision needs to be produced by the finishing processing in consideration of the clearance between the thread groove spacer and the cylindrical rotating body.

In such a case where the surfaces B are subjected to the surface treatment removal processing, and even if the cylindrical section (the cylindrical rotating body) comes into contact with the thread groove spacer for some reason, resultant particles (fine dust particles) that come off of the finish of the surfaces B can be prevented from scattering in the vacuum system through the vacuum pump.

Owing to the configuration described above of the turbomolecular pump 1 according to the modification of the first embodiment of the present invention, the masking process no longer needs to be executed, reducing the number of processing steps by one, and hence reducing the cost of the manufacturing process.

(ii-2) Second Embodiment (Stator Blade Spacers Surface Treatment Removal Processing is Performed)

Figure 3:
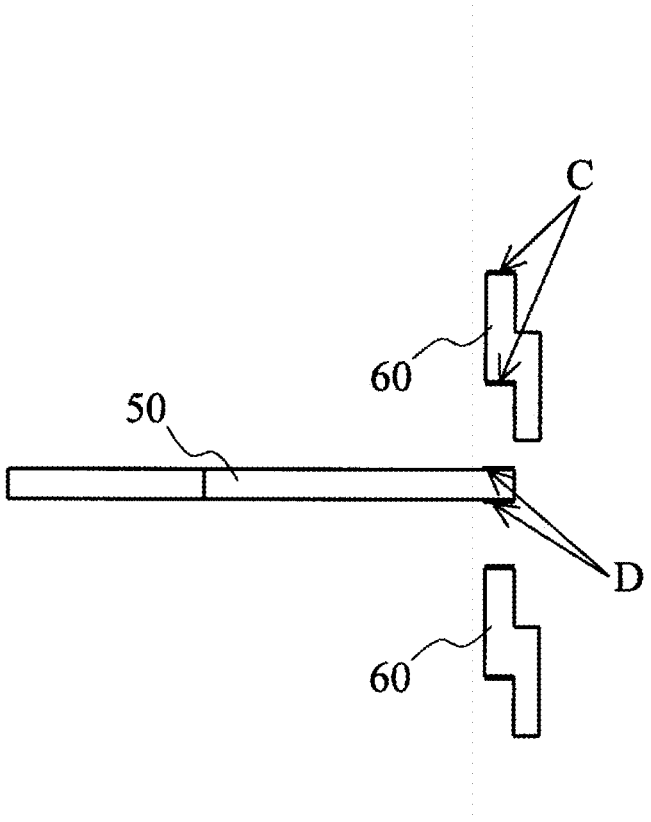
FIG. 3 is an enlarged view of a stator blade and stator blade spacers according to the second and third embodiments of the present invention.

FIG. 3 is an enlarged view of one of the stator blades 50 and the stator blade spacers 60 according to the second embodiment of the present invention.

In the first embodiment of the present invention, the surface treatment removal processing is performed on the thread groove spacer 70 of the thread groove type pump portion of the turbomolecular pump 1.

For the purpose of efficiently absorbing heat (i.e., efficiently releasing heat) of each rotary blade 9 that rotates at high speed, in the turbomolecular pump 1 according to the second embodiment of the present invention, contact surfaces C of each stator blade spacer 60 in contact with the stator blade 50 facing the rotary blade 9 are subjected to the surface treatment removal processing for removing the surface treatment thereof, to expose the original base metal.

Such a configuration of the turbomolecular pump 1 according to the second embodiment of the present invention can enhance heat dissipation of the rotor (each rotary blade 9) more efficiently.

(ii-3) Third Embodiment (Stator Blades that Surface Treatment Removal Processing is Performed)

For the purpose of efficiently absorbing heat of each rotary blade 9, in the turbomolecular pump 1 according to the third embodiment of the present invention, the stator blade 50 facing the rotary blade 9 has its contact surfaces D subjected to the surface treatment removal processing for removing the surface treatment thereof, the contact surfaces D coming into contact with the stator blade spacers 60 respectively.

Such a configuration of the turbomolecular pump 1 according to the third embodiment of the present invention can enhance heat dissipation of the rotor (each rotary blade 9) more efficiently.

(ii-4) Fourth Embodiment (Examples of Thread Groove Type Pump)

Figure 4:
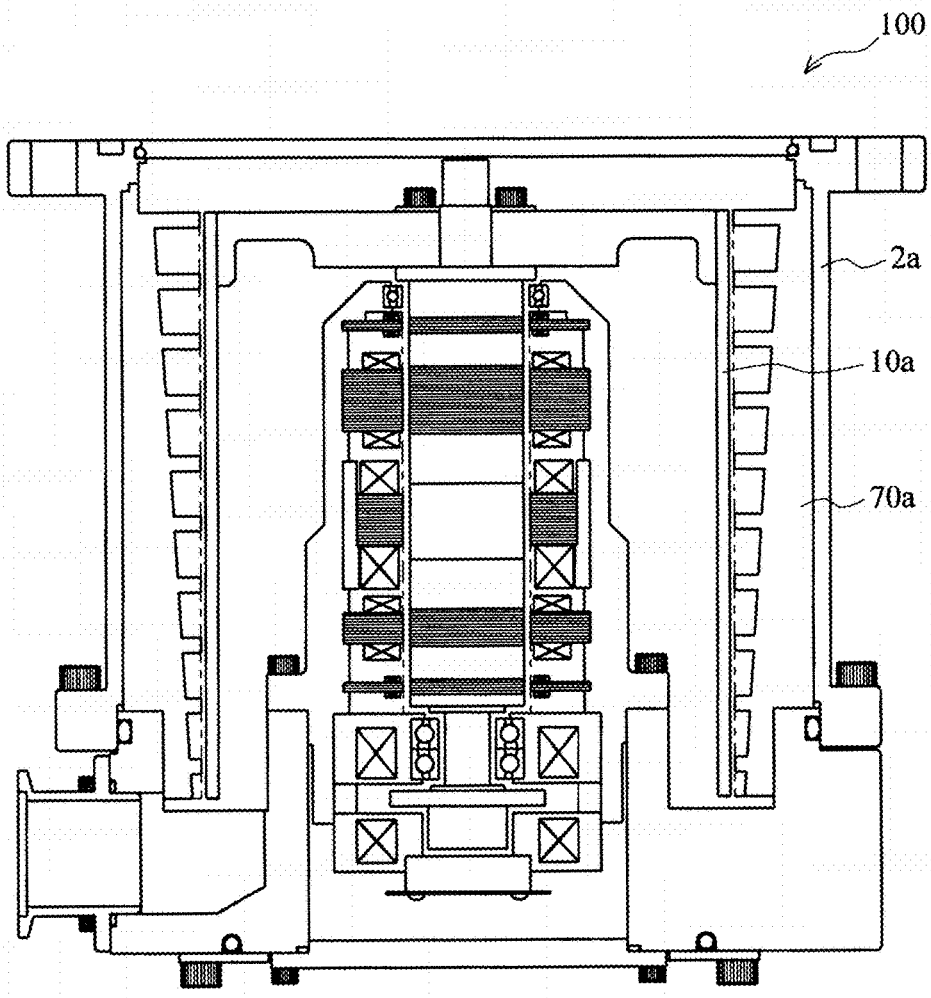
FIG. 4 is a diagram showing an example of a schematic configuration of a thread groove type pump according to a fourth embodiment of the present invention.

FIG. 4 is a diagram showing an example of a schematic configuration of a thread groove type pump 100 according to the fourth embodiment of the present invention.

Note that FIG. 4 shows an axial cross-sectional view of the thread groove type pump 100.

The fourth embodiment is described using a thread groove type pump as an example of the vacuum pump. Note that descriptions of the configurations same as those of the first to third embodiments are omitted hereinafter.

A spiral groove is formed at surfaces of a thread groove spacer 70*a* that face a cylindrical rotating body 10*a* made of FRP.

The thread groove spacer 70*a* faces an outer circumferential surface of the cylindrical rotating body 10*a* with a predetermined clearance therebetween, and is configured to send gas toward the outlet port 6 side while guiding the gas along the thread groove (spiral groove) as the cylindrical rotating body 10*a* rotates at high speed. In other words, the thread groove configures a flow path for transporting the gas. The gas transfer mechanism for transferring gas is configured by this thread groove that is formed by the thread groove spacer 70*a* and the cylindrical rotating body 10*a* facing each other with a predetermined clearance therebetween.

The smaller this clearance is, the better, in order to reduce the force of gas flowing back toward the inlet port 4.

The spiral groove formed in the thread groove spacer 70*a* extends toward the outlet port 6, in a case where the gas is transported through the spiral groove in the direction of rotation of the rotor 8.

The spiral groove is also configured to become shallower toward the outlet port 6, so the gas that is transported through the spiral groove is compressed more toward the outlet port 6 and then discharged from the outlet port 6.

The thread groove type pump 100 with this configuration can execute an evacuation treatment in a vacuum chamber (not shown) disposed in the thread groove type pump 100.

In the thread groove type pump 100 according to the fourth embodiment of the present invention, the thread groove spacer 70*a* is subjected to a surface treatment producing high emissivity (i.e., high thermal absorptivity), such as a nickel oxide coating treatment or an alumite treatment (anodic oxidation coating with aluminum and aluminum alloy).

Executing this treatment on the thread groove spacer 70*a* results in high thermal absorption, a lower thermal conductivity than that obtained prior to the execution of the surface treatment, and to avoid smooth conduction of the heat of the thread groove spacer 70*a* to the base 3 and a casing 2*a*.

For the purpose of efficiently absorbing the heat of the thread groove spacer 70*a* (i.e., efficiently releasing the heat of the thread groove spacer 70*a*), in the thread groove type pump 100 according to the fourth embodiment of the present invention, a contact surface A1 of the thread groove spacer 70*a* that is in contact with the base 3 and a contact surface A2 that is in contact with the casing 2*a* are subjected to surface treatment removal processing for removing the surface treatment thereof, to expose the original base metal.

Owing to the configuration described above of the thread groove type pump 100 according to the fourth embodiment of the present invention, the heat of the thread groove spacer 70*a* can efficiently be released, efficiently improving heat dissipation of the rotor (cylindrical rotating body 10*a*).

The manufacturing processes according to the second to fourth embodiments are the same as that of the modification of the first embodiment; therefore, descriptions thereof are omitted accordingly.

The sections to be subjected to the surface treatment removal processing are not limited to the parts A1 to A3, C, or D described in the embodiments. Therefore, the surface treatment removal processing can be executed on sections that are in contact with the members. In addition, if necessary, the configurations can be modified in any ways, e.g., executing surface treatment removal processing only on either one of the members.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

EXPLANATION OF REFERENCE NUMERALS

1 Turbomolecular pump
100 Thread groove type pump
2 Casing
2*a* Casing
3 Base
4 Inlet port
5 Flange portion
6 Outlet port
7 Shaft
8 Rotor
9 Rotary blade
10 Cylindrical rotating body
10*a* Cylindrical rotating body
20 Motor portion
30, 31 Radial magnetic bearing device
40 Axial magnetic bearing device
50 Stator blade
60 Stator blade spacer
70 Thread groove spacer
70*a* Thread groove spacer
80 Stator column

What is claimed is:

1. A stator member, which is provided in a gas transfer mechanism disposed inside a casing having an inlet port and an outlet port, wherein the stator member faces a rotating body that is disposed on a rotating shaft and transfers gas from the inlet port to the outlet port, and moreover the stator member is subjected to a surface treatment in at least a part thereof, the surface treatment decreasing thermal conductivity by increasing emissivity, wherein the stator member is not subjected to the surface treatment on a contact surface of the stator member, and wherein the contact surface is in contact with at least one of other members, the gas transfer mechanism has a thread groove type pump portion, and the stator member is a thread groove spacer, and the thread groove spacer is not subjected to the surface treatment at least on a part of a surface of the thread groove spacer that faces the rotating body.

2. The stator member according to claim 1, wherein the gas transfer mechanism further has a turbomolecular pump portion, and further has a stator blade spacer as the stator member.

3. The stator member according to claim 1, wherein the gas transfer mechanism further has a turbomolecular pump portion, and further has a stator blade as the stator member.

4. A vacuum pump, comprising the casing, the rotating shaft, the rotating body, and the stator member according to claim 1.

5. The vacuum pump according to claim 4, wherein the rotating body is joined to a cylindrical body made of a fiber reinforced composite material.

6. A vacuum pump, comprising the casing, the rotating shaft, the rotating body, and the stator member according to claim 2.

7. The vacuum pump according to claim 6, wherein the rotating body is joined to a cylindrical body made of a fiber reinforced composite material.

* * * * *